US010437168B2

(12) United States Patent
Koga et al.

(10) Patent No.: US 10,437,168 B2
(45) Date of Patent: Oct. 8, 2019

(54) INTERMEDIATE TRANSFER BELT AND IMAGE-FORMING APPARATUS

(71) Applicant: Konica Minolta, Inc., Tokyo (JP)

(72) Inventors: Ito Koga, Hino (JP); Sadaaki Sakamoto, Hachioji (JP); Shiori Tsugawa, Hino (JP); Eiichi Yoshida, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/273,600

(22) Filed: Feb. 12, 2019

(65) Prior Publication Data

US 2019/0265605 A1 Aug. 29, 2019

(30) Foreign Application Priority Data

Feb. 28, 2018 (JP) ..... 2018-034207

(51) Int. Cl.

| | |
|---|---|
| ***G03G 15/20*** | (2006.01) |
| ***G03G 15/01*** | (2006.01) |
| ***G03G 15/08*** | (2006.01) |
| ***G03G 15/16*** | (2006.01) |

(52) U.S. Cl.

CPC ..... *G03G 15/0189* (2013.01); *G03G 15/08* (2013.01); *G03G 15/162* (2013.01); *G03G 15/1615* (2013.01)

(58) Field of Classification Search

CPC ..... G03G 15/0184; G03G 15/0189; G03G 15/0194; G03G 15/1615; G03G 15/162; G03G 15/08; G03G 5/043

See application file for complete search history.

(56) References Cited

U.S. PATENT DOCUMENTS

| | | | | |
|---|---|---|---|---|
| 7,142,800 | B2 * | 11/2006 | Natori | G03G 15/1685 399/302 |
| 7,292,813 | B2 * | 11/2007 | Ichizawa | G03G 15/1685 399/302 |
| 7,809,315 | B2 * | 10/2010 | Suzuki | B29D 29/00 399/302 |

FOREIGN PATENT DOCUMENTS

| | | |
|---|---|---|
| JP | H08152759 A | 6/1996 |
| JP | 2000231289 A | 8/2000 |

* cited by examiner

*Primary Examiner* — Hoang X Ngo
(74) *Attorney, Agent, or Firm* — Lucas & Mercanti, LLP

(57) ABSTRACT

Disclosed is an intermediate transfer belt used for an electrophotographic image-forming apparatus, wherein the intermediate transfer belt contains a substrate layer and a surface layer; the intermediate transfer belt has a relative dielectric constant of 15 or more, and a volume resistivity at an applied voltage of 100 V in the range of $1.0\times10^5$ to $9.0\times10^9$ Ω·cm under an environment of temperature of 23° C. and humidity of 50% RH; and the surface layer has a relative dielectric constant of 6 or less.

8 Claims, 2 Drawing Sheets

INTERMEDIATE TRANSFER BELT AND IMAGE-FORMING APPARATUS

Japanese Patent Application No. 2018-034207, filed on Feb. 28, 2018 with Japan Patent Office, is incorporated herein by reference in its entirety.

TECHNICAL FIELD

The present invention relates to an intermediate transfer belt and an image-forming apparatus. More specifically, the present invention relates to an intermediate transfer belt excellent in uneven paper transferability and durability, and an image-forming apparatus provided with the same intermediate transfer belt.

BACKGROUND

In the past, as an electrophotographic image-forming apparatus using an intermediate transfer belt, the following is known. A toner image formed on a photoreceptor is transferred onto an intermediate transfer belt, and then, the toner image on the intermediate transfer belt is transferred to a transfer material such as transfer paper (recording paper). That is, after primary transfer of a toner image charged on a predetermined polarity formed on a photoreceptor to an intermediate transfer belt, the toner image on the intermediate transfer belt is secondarily transferred onto a transfer material using electrostatic force.

An image-forming apparatus using such an intermediate transfer belt sequentially superimposes toner images formed on each photoreceptor on an intermediate transfer belt by utilizing electrostatic force. Further, it is possible to collectively transfer the superimposed toner images to the transfer material. Therefore, it is widely used as a color image-forming apparatus.

In recent electrophotographic image-forming apparatuses, various transfer materials are used, and not only plain paper and OA exclusive paper but also thick paper or coated paper, and paper having irregularities on the surface (hereinafter also referred to as "uneven paper") are required to handle as a paper type. Particularly, embossed uneven paper on its surface is increasingly used for business cards and for a cover of printed matter from its unique texture.

However, it is known that uneven papers are inferior in transferability as compared with other smooth papers, and it is difficult to satisfactorily form images thereon. Various studies have been made in order to improve uneven paper transferability.

For example, by using an elastic belt, it is possible to improve transferability by deforming the belt along the surface shape of the uneven paper. However, when the belt is stretched and contracted during transfer, there is produced a problem that the belt deteriorates due to prolonged use and cracks.

In order to increase the transferability, it is conceivable to strengthen the transfer electric field acting on the toner. However, when the applied voltage at the time of transfer is increased in order to strengthen the transfer electric field, image noise due to discharge occurs. As a method of increasing the transfer electric field to the toner with the same applied voltage, it has been studied to lower the volume resistivity of the intermediate transfer belt or increase the relative dielectric constant of the intermediate transfer belt (refer to Patent Documents 1 and 2: JP-A 2000-231289 and JP-A 08-152759).

However, when the relative dielectric constant of the intermediate transfer belt is increased in order to increase the transfer electric field acting on the toner, the image force of the intermediate transfer belt and the toner is increased by the dielectric polarization. This is disadvantageous for secondary transfer of the toner from the intermediate transfer belt to the transfer material. In addition, when a filter having a high dielectric constant (it may be called as a high dielectric filler) is added, durability deteriorates, such as cracking at the interface, therefore and intermediate transfer belt excellent in uneven paper transferability and durability has been desired.

SUMMARY

The present invention has been made in view of the above problems and circumstances. An object of the present invention is to provide an intermediate transfer belt excellent in concavo-convex paper (uneven paper) transferability and durability. An object of the present invention is also to provide an image-forming apparatus provided with the same intermediate transfer belt.

In order to solve the above problem, the present inventors examined the cause of the above problem. As a result, it was found that even if the transfer electric field acting on the toner is raised, by providing a surface layer having a low dielectric constant on the intermediate transfer belt, an intermediate transfer belt excellent in irregular sheet transferability and durability is possible. Thus the present invention has been achieved.

That is, the above object according to the present invention can be attained by the following means.

An intermediate transfer belt reflecting an aspect of the present invention is an intermediate transfer belt used for an electrophotographic image-forming apparatus, wherein the intermediate transfer belt comprises a substrate layer and a surface layer; the intermediate transfer belt has a relative dielectric constant of 15 or more, and a volume resistivity at an applied voltage of 100 V in the range of $1.0\times10^5$ to $9.0\times10^9$ Ω·cm under an environment of temperature of 23° C. and humidity of 50% RH; and the surface layer has a relative dielectric constant of 6 or less.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
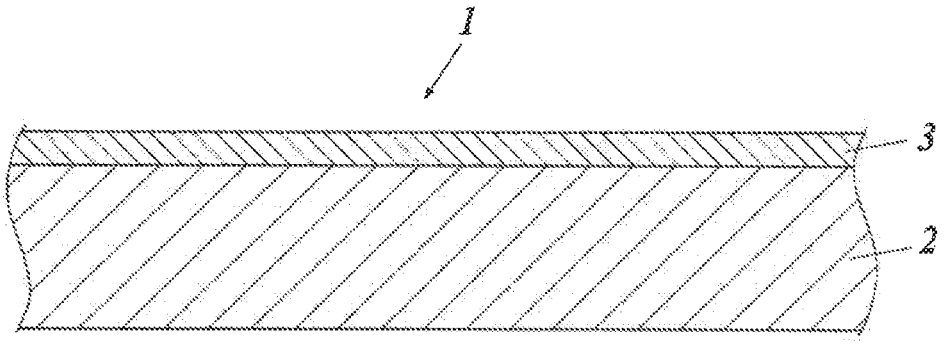
FIG. 1 is a conceptual cross-sectional view illustrating an example of a layer configuration of an intermediate transfer belt.

Hereinafter, one or more embodiments of the present invention will be described with reference to the drawings. However, the scope of the invention is not limited to the disclosed embodiments.

An intermediate transfer belt of the present invention is an intermediate transfer belt used for an electrophotographic image-forming apparatus, wherein the intermediate transfer belt comprises a substrate layer and a surface layer; the intermediate transfer belt has a relative dielectric constant of 15 or more, and a volume resistivity at an applied voltage of 100 V in the range of $1.0\times10^5$ to $9.0\times10^9$ Ω·cm under an environment of temperature of 23° C. and humidity of 50% RH; and the surface layer has a relative dielectric constant of 6 or less. This feature is a technical feature common or corresponding to the embodiments of the present invention.

By the above means of the present invention, it is possible to provide an intermediate transfer belt excellent in uneven paper transferability and durability. Further, it is possible to provide an image-forming apparatus provided with this intermediate transfer belt.

A formation mechanism or an action mechanism of the effects of the present invention is not clearly identified, but it is supposed as follows.

Increasing the relative dielectric constant of the intermediate transfer belt and decreasing the volume resistivity enable to increase the transfer electric field acting on the toner. Further, by providing a surface layer having a low dielectric constant on the toner transfer surface of the intermediate transfer belt, it is possible to suppress the image force between the intermediate transfer belt and the toner. Thereby, it is presumed that it became possible to increase the transferability of the toner to the uneven paper.

In an embodiment of the present invention, the relative dielectric constant of the intermediate transfer belt is preferably in the range of 20 to 60 from the viewpoint of developing the effect of the present invention.

In addition, the volume resistivity is preferably in the range of $5.0\times10^6$ to $5.0\times10^8$ Ω·cm from the viewpoint of developing the effect of the present invention.

Furthermore, in the present invention, the relative dielectric constant of the surface layer is preferably in the range of 3 to 5.

Further, it is preferable that the substrate layer contains a filler having a high dielectric constant since it is possible to make the relative dielectric constant to a desired value.

Further, in the present invention, it is preferable that the universal hardness value is in the range of 50 to 80 MPa ($N/mm^2$) under the above measurement conditions. Thereby, the durability of the intermediate transfer belt may be improved.

In an embodiment of the present invention, it is preferable that the thickness of the surface layer is in the range of 2 to 20 μm so as to more effectively exhibit the effect of improving the transfer electric field acting on the toner and suppressing the image force.

The intermediate transfer belt of the present invention can be suitably provided in an image-forming apparatus.

Hereinafter, the present invention and the constitution elements thereof, as well as configurations and embodiments for carrying out the present invention will be detailed in the following. In the present description, when two figures are used to indicate a range of value before and after "to", these figures are included in the range as a lowest limit value and an upper limit value.

In the present invention, the "surface layer" refers to a layer which is the outermost layer of the intermediate transfer belt and carries toner to be transferred.

<<Outline of Intermediate Transfer Belt>>

An intermediate transfer belt of the present invention is an intermediate transfer belt used for an electrophotographic image-forming apparatus, wherein the intermediate transfer belt comprises a substrate layer and a surface laver; the intermediate transfer belt has a relative dielectric constant of 15 or more and a volume resistivity at an applied voltage of 100 V in the range of $1.0\times10^5$ to $9.0\times10^9$ Ω·cm under an environment of temperature of 23° C. and humidity of 50% RH; and the surface layer has a relative dielectric constant of 6 or less.

In order to increase the uneven paper transferability, it is conceivable to strengthen the transfer electric field acting on the toner. When the relative dielectric constant of the intermediate transfer belt is increased, the capacitance increases and the electric field applied to the intermediate transfer belt decreases. As a result, the transfer electric field to the toner can be increased. Further, when the volume resistivity of the intermediate transfer belt is decreased, the transfer electric field applied to the toner can be increased.

When the relative dielectric constant is increased while decreasing the volume resistivity of the intermediate transfer belt, it was confirmed that the transferability of the toner is improved more than expected. The transferability of the toner is improved more than expected. Although detailed phenomenon is unknown, it is presumed that low volume resistivity and high dielectric constant worked efficiently.

On the other hand, when the relative dielectric constant of the intermediate transfer belt is increased, the image force between the toner and the intermediate transfer belt becomes strong due to the dielectric polarization inside the intermediate transfer belt. As a result, at the time of the secondary transfer, a larger force is required to cancel this.

In the present invention, the intermediate transfer belt is made to have a high dielectric constant. By providing a surface layer of a low dielectric constant having a low polarization on the surface (toner transfer surface) of the intermediate transfer belt, the image force between the toner and the intermediate transfer belt is suppressed, and a transfer electric field is efficiently applied to the toner. Thereby it became possible to improve the uneven paper transferability. It is also considered that the durability of the intermediate transfer belt can be improved by providing a surface layer on the toner transferring surface.

FIG. 1 is a conceptual cross-sectional view illustrating an example of the layer configuration of the intermediate transfer belt. In FIG. 1, the numeral 1 denotes an intermediate transfer belt, the numeral 2 denotes a substrate layer, and the numeral 3 denotes a surface layer. The substrate layer may be made to be a high dielectric constant layer and the surface layer may be made to be a low dielectric constant layer.

[Relative Dielectric Constant]

The intermediate transfer belt of the present invention has a relative dielectric constant of 5 or more under an environment of temperature of 23° C. and humidity of 50% RH. By setting the volume resistivity within the above range, it is possible to strengthen the transfer electric field acting on the toner. Preferably, the relative dielectric constant is in the range of 20 to 60. When the relative dielectric constant is lower than 15, it is difficult to increase the transfer electric field, which is not preferable. There is no particular limitation on the upper limit of the relative dielectric constant, and it is restricted from the materials used.

Adjustment of the relative dielectric constant of the intermediate transfer belt may be done by including a filler having a high dielectric constant in the intermediate transfer belt. In the present invention, the substrate layer may be a high dielectric constant layer and the surface layer may be a low dielectric constant layer.

The relative dielectric constant of the intermediate transfer belt may be measured with an LCR meter using a sample obtained by vapor depositing silver having a thickness of 100 μm on both sides of an intermediate transfer belt and cutting it into a circle having a diameter of 1 cm. As the LCR meter, for example, an E4990A impedance analyzer (manufactured by Keysight Co. Ltd.) may be used.

In the intermediate transfer belt of the present invention, the relative dielectric constant of the surface layer is 6 or less. Preferably, the relative dielectric constant of the surface layer is in the range of 3 to 5. When the relative dielectric constant of the surface layer exceeds 6, it is difficult to weaken the image force, which is not preferable.

By making the surface layer to be such a low dielectric constant layer, even if the transfer electric field acting on the toner is strengthened, the image force is not increased. As a result, it is thought that secondary transferability is excellent and uneven paper transferability is improved.

The relative dielectric constant of the surface layer can be measured in the same manner as in the case of the intermediate transfer belt. It can be carried out by using a layer produced by scraping the molded belt sample from the back so as to leave only 2 μm from the surface of the belt or a peeled surface layer.

[Volume Resistivity]

The intermediate transfer belt of the present invention has a volume resistivity in the range of $1.0\times10^5$ to $9.0\times10^9$ Ω·cm at an applied voltage of 100 V under an environment of temperature of 23° C. and humidity of 50% RH. By setting the aforementioned relative dielectric constant to be above-mentioned range, it is possible to strengthen the transfer electric field acting on the toner. Preferably, the volume resistivity is in the range of $5.0\times10^6$ to $5.0\times10^8$ Ω·cm.

The volume resistivity of the intermediate transfer belt may be adjusted by controlling the kind and amount of the conductive material contained in the intermediate transfer belt.

The volume resistivity is measured under the following apparatus and measurement conditions.

Resistivity meter: Hiresta-UX (manufactured by Mitsubishi Chemical Analytics Co., Ltd.)

Electrode: URS probe (manufactured by Mitsubishi Chemical Analytics Co., Ltd.)

<Measurement Conditions>

Measurement atmosphere: temperature 23° C., humidity 50% RH

Applied voltage: 100 V

Application time: 10 sec

The obtained endless belt formed (diameter 120 mm, width 238 mm) intermediate transfer belt was incised. 16 points at equal intervals in the width direction and in the length direction were measured under the measuring apparatus and the measurement conditions, and the average value was obtained. The load at the time of measurement in 2.0 kgf (19.6 N).

[Universal Hardness of Intermediate Transfer Belt]

The intermediate transfer belt of the present invention preferably has a universal hardness value on the surface layer side in the range of 50 to 80 MPa ($N/mm^2$) when measurement is done by pressing with a Vickers square pyramid indenter at a maximum load of 2 mN under an environment of temperature of 23° C. and humidity of 50 % RH. By setting such a hardness value, it is possible to improve the durability of the intermediate transfer belt.

In the present invention, universal hardness is obtained by pressing an indenter into an object to be measured while applying a load, and it is obtained by the following equation (1), and the unit expressed in MPa ($N/mm^2$).

Universal hardness=(test load)/(contact surface area of indenter with measuring object under test load) Equation (1):

The measurement of the universal hardness may be carried out using a commercially available hardness measuring apparatus, and it may be measured using, for example, an ultramicro hardness meter "H-100V" (manufactured by Fischer Instruments Co. Ltd.). In this measuring apparatus, a quadrangluar pyramid indenter is pushed into an object to be measured while applying a test load, and from the indentation depth at the time when the indenter reaches a desired depth, the surface area of the indenter in contact with the object to be measured is define as a universal hardness vale which is calculated from the above equation (1).

<Measurement Conditions>

Measuring machine: Hardness meter indentation tester "H-100V" (manufactured by Fischer Instruments Co. Ltd.)

Measuring indenter: Vickers indenter

Measurement environment: Temperature 23° C., humidity 50% RH

Measurement sample: Cut the intermediate transfer belt to a size of 5 cm×5 cm to prepare a measurement sample Maximum test load: 2 mN Load condition: Apply a load in proportion to time at a speed reaching at maximum test load in 10 sec.

Load creep time: 5 seconds

For each measurement, 10 points are randomly measured for each material, and the average value is defined as the hardness defined by the universal hardness.

<<Detail of Intermediate Transfer Belt>>

The intermediate transfer belt of the present invention contains a substrate layer and a surface layer, and has a relative dielectric constant of 15 or more and a volume resistivity as an applied voltage of 100 V in the range of $1.0\times10^5$ to $9.0\times10^9$ Ω·cm under an environment of temperature of 23° C. and humidity of 50% RH. Further, the surface layer has a relative dielectric constant of 6 or less.

Further, it is preferable that the intermediate transfer belt has a shape of endless structure from the viewpoint that there is no change in thickness due to superimposition, an arbitrary portion may be set as the start position of the belt rotation, and the control mechanism of the rotation start position can be omitted.

[Substrate Layer]

The substrate layer according to the present invention is formed with a substrate forming composition containing a resin, a conductive material and a ferroelectric filler.

(Resin)

The substrate layer according to the present invention is not limited in particular. It may he produced with a known resin by using a known forming method. Examples of a known resin are resins such as: polycarbonate, polyphenylene sulfide, polyvinylidene fluoride, polyimide, polyamide, polyamideimide, polyether, and polyether ketones; and resins having polyphenylene sulfide as a main component.

Of these, polyimide, polyamide and polyamideimide are preferable. Among them, polyimide is more preferable. Polyimide is excellent in characteristics such as heat resistance, flexing resistance, flexibility, and dimensional stability, and it is suitably used for an intermediate transfer belt in an image-forming apparatus. Polyimide is obtained, for example, by synthesizing a polyamic acid (polyimide precursor) from an acid anhydride and a diamine compound and imidizing the polyamic acid with heat or a catalyst. The acid anhydride used for the synthesis of polyimide is not particularly limited. Examples thereof are aromatic tetracarboxylic dianhydrides such as: biphenyltetracarboxylic dianhydride, terphenyltetracarboxylic dianhydride, benzophenonetetracarboxylic dianhydride, pyromellitic anhydride, oxydiphthalic dianhydride, diphenylsulfone tetracarboxylic dianhydride, hexafluoroisopropylidene diphthalic acid dianhydride, and cyclobutanetetracarboxylic acid dianhydride.

The diamine compound used for the synthesis of polyimide is not particularly limited. Examples thereof are aromatic diamines such as: p-phenylenediamine, m-phenylenediamine, 2,4-diaminotoluene, 4,4'-diaminodiphenylmethane, 4,4'-diaminodiphenyl ether, 3,4'-diaminodiphenyl ether, 3,3'-dimethyl-4,4'-diaminobiphenyl, 2,2'-bis (trifluoromethyl)-4,4'-diaminobiphenyl), 3,7-diamino-dimethyldibenzothiophene-5,5'-dioxide, 4,4'-diaminobenzophenon, 4,4'-bis(4-aminophenyl) sulfide, 4,4'-diaminobenzanilide, and 1,4-bis(4-aminophenoxy)benzene.

(Conductive Agent)

As the conductive agent dispersed in the substrate layer of the present invention, well-known electron conductive substances and ion conductive substances may be used.

Examples of the electron conductive substance are: carbon black; carbon for rubber such as SAF (super wear resistance), ISAF (quasi super abrasion resistance), HAF (high abrasion resistance), FEF (good extrusion property), GPF (versatility), SRF (medium reinforcement), FT (fine particle pyrolytic property), MT (medium grain thermally decomposable); carbon for color (ink) subjected to oxidation treatment, pyrolytic carbon, natural graphite, synthetic graphite; antimony-doped tin oxide, titanium oxide, zinc oxide; metals and metal oxides made of nickel, copper, silver, and germanium; and conductive polymers such as polyaniline, polypyrrole, and polyacetylene.

Examples of the ion conductive substances are: inorganic ionic conductive substances such as sodium perchlorate, lithium perchlorate, calcium perchlorate, and lithium chloride; organic ionic conductive substances such as perchlorate, sulfate, ethosulfate, methylsulfate, phosphate, fluoroborate, and acetate of quaternary ammonium; and charge transfer complexes. Specific examples of the organic ionic conductive substance are: tridecyl methyl dihydroxyethyl ammonium perchlorate, lauryl trimethyl ammonium perchlorate, modified aliphatic dimethylethylammonium ethosulfate, N,N'-bis(2-hydroxyethyl)-N-(3'-dodecyloxy-2'-) methyl ammonium ethosulfate, 3-lauramidopropyltolymethyl ammonium methyl sulfate, stearamidopropyl dimethyl-β-hydroxyethyl-ammonium dihydrogen phosphate, tetrabutyl ammonium borate, stearyl ammonium acetate, and lauryl ammonium acetate.

These conductive agents may be used singly or in combination of two or more.

Among the conductive agents, carbon black is preferably used. As the carbon black, for example, gas black, acetylene black, oil furnace black, thermal black, channel black, and ketjen black may be mentioned. Ketjen black, acetylene black and oil furnace black may be cited as effective ones for obtaining a desired conductivity with a smaller amount of mixing. It should be noted that Ketjen black is carbon black of a contactive furnace system.

By appropriately using the above-mentioned conductive agent, conductivity can be imparted to the substrate layer, and the volume resistivity of the intermediate transfer belt may be adjusted within the range according to the present invention. The content of the conductive agent is from 6 to 20 mass %, preferably from 8 to 12 mass %, based on 100 mass % of the substrate layer forming composition when the above-mentioned electron conductive substance is used as the conductive agent. When the ion conductive substance is used as the conductive agent, it is preferably used in an amount of 10 to 50 mass %, particularly 20 to 40 mass %, based on 100 mass % of the substrate layer forming composition.

(High Dielectric Filler)

In order to make the relative dielectric constant of the intermediate transfer belt of the present invention equal to or greater than 15, it is preferable that a high dielectric filler having a relative dielectric constant of 100 or more is contained in the substrate layer.

Examples of the high dielectric filler include dielectric ceramics such as titanium dioxide ($TiO_2$), barium titanate ($BaTiO_3$), tantalum oxide ($Ta_2O_3$), strontium titanate (STO: $SrTiO_3$), barium strontium titanate (BST: $(Ba_xSr_{1-x})TiO_3$), lead zirconate titanate (PZT: $Pb(Zr,Ti)O_3$), and lead lanthanate zirconate titanate (PLZT: $(Pb,La)(Zr,Ti)O_3$: La(lanthanum) added lead zirconate titanate). Since the dielectric ceramic itself has a high relative dielectric constant, by including a high dielectric filler in the substrate layer, the relative dielectric constant of the whole intermediate transfer belt 10 may be made high dielectric constant of 15 or more. The amount of the high dielectric filler to be added varies depending on the desired physical properties, but it is preferably added in an amount of 10 to 60 volume %, more preferably 20 to 50 volume %, based on the substrate layer forming composition.

In addition to the high dielectric filler, other inorganic fillers may be added to the substrate layer according to the present invention. The inorganic filler is not particularly limited, and various known inorganic fillers that can be added to the resin may be used. Examples thereof include talc, mica, calcium carbonate, silica, and glass fiber. Talc is particularly preferable from the viewpoint of compatibility with the polyimide resin. Furthermore, in order to improve the compatibility of the inorganic filler with the polyimide resin, the inorganic filler may be appropriately surface-treated. As the surface treatment method, a known treatment with a coupling agent such as a silane coupling agent, a titanate coupling agent, an aluminum coupling agent, or a zirconium coupling agent may be mentioned.

By appropriately adding the above-mentioned inorganic filler, it is possible to improve the tensile elastic modulus and the universal hardness of the substrate layer.

Further, the thickness of the substrate layer is in the range of 30 to 200 μm, preferably 50 to 100 μm. When the thickness falls within the above range, the handling property of the belt is good, the breakage failure is small, and the manufacturing cost is excellent.

When needed, known additives added to the resin may be blended appropriately in the substrate layer. Examples of the additive are: antioxidant, heat stabilizer, plasticizer, light stabilizer, lubricant, antifogging agent, anti-blocking agent, slip agent, crosslinking agent, crosslinking aid, adhesive, flame retardant, and dispersant.

[Surface Layer]

The intermediate transfer belt of the present invention has a surface layer and has a relative dielectric constant of 6 or less. The surface layer is formed with a surface layer forming composition containing a resin and a conductive agent.

The resin contained in the surface layer is not particularly limited, and it is possible to use an existing resin such as an acrylic resin, a polyester resin, a polysiloxane resin, a fluororesin, a polysiloxane resin, a polyamideimide resin, or a polyimide resin. Like the substrate layer, polyimide is preferably used. Polyimide is excellent in characteristics such as heat resistance, flexing resistance, flexibility, and dimensional stability, and is suitably used for an intermediate transfer belt in an image-forming apparatus. Among the above-mentioned polyimides, aromatic polyimide is preferable as the resin contained in the surface layer. Further, polysiloxane and fluororesin may also be preferably used. As the fluororesin, PVDF (polyvinylidene fluoride) may be mentioned.

Examples of the aromatic polyimide resin include those having an imide group in the main skeleton such as aromatic polyimide, aromatic polyamide imide, and aromatic polyester imide. Further, silicone modified polyimide copolymerized with soft segment and urethane modified polyimide may be mentioned. Among them, an aromatic polyamide imide resin excellent in molding processability is preferable.

The aromatic polyamide imide resin is not particularly limited, and various known ones can be used. Usually, the aromatic polyamide-imide resin is produced by condensation polymerization of an acid component represented by trimellitic anhydride and an aromatic diamine or aromatic diisocyanate by a known method. Therefore, the acid component and aromatic diamine or aromatic diisocyanate may be dissolved in a solvent to prepare the surface layer forming composition of the present invention.

Examples of the solvent which may be used at this time are: N-methyl-2-pyrrolidone, N,N-dimethylacetamide, dimethyl sulfoxide, hexamethylphosphonyl triamide, cyclohexanone, γ-butyrolactone, methyl alcohol, tetrahydrofuran, ethanol, and xylene. According to necessity, phenols such as cresol, phenol and xylenol, and hydrocarbons such as hexane benzene and toluene may be mixed. These may be used singly or as a mixture of two or more. A preferred organic solvent is N,N-dimethylacetamide.

As the acid component used in the surface layer-forming composition, trimellitic acid and its anhydride or acid chloride can be mentioned. Other examples of the acid component include: tetracarboxylic acids such as pyromellitic acid, biphenyltetracarboxylic acid, biphenylsulfone tetracarboxylic acid, benzophenonetetracarboxylic acid, biphenyl ether tetracarboxylic acid, ethylene glycol bistrimellitate, and propylene glycol bistrimellitate and anhydride thereof; aliphatic dicarboxylic acids such as oxalic acid, adipic acid, malonic acid, sobacic acid, azelaic acid, dodecanedicarboxylic acid, dicarboxypolybutadiene, dicarboxypoly (acrylonitrile-butadiene), and dicarboxypoly (styrene-butadiene); aliphatic dicarboxylic acid such as cyclohexane carboxylic acid; alicyclic carboxylic acids such as 1,4-cyclohexane dicarboxylic acid, 1,3-cyclohexane dicarboxylic acid, 4,4'-dicyclohexyl methane dicarboxylic acid, and dimer acid; and aromatic dicarboxylic acid such as terephthalic acid, isophthalic acid, diphenylsulfone dicarboxylic acid, diphenyl ether dicarboxylic acid, and naphthalene dicarboxylic acid. These can be used singly or in combination of two or more kinds. Among them, trimellitic anhydride is preferably used.

Examples of the aromatic diamine include: m-phenyldiamine, p-phenyldiamine, 2,4-aminotoluene, 2,6-aminotoluene, 2,4-diaminochlorobenzene, m-xylylenediamine, p-xylylenediamine, 1,4-diaminonaphthalene, 1,5-diaminonaphthalene, 2,6-diaminonaphthalene, 2,4'-diaminonaphthalenebiphenyl, benzidine, 3,3-dimethylbenzidine, 3,3'-dimethoxybenzidine, 3,4'-diaminodiphenyl ether, 4,4'-diaminodiphenyl ether (ODA), 4,4'-diaminodiphenyl sulfide, 3,3'-diaminobenzophenone, 4,4'-diaminophenylsulfone, 4,4'-diaminoazobenzene, 4,4'-diamino Diphenylmethane, and bis-aminophenylpropane. Preferable are polyamide resins obtained by using p-phenyldiamine, or 4,4'-diaminodiphenyl ether (ODA) as an aromatic diamine component.

Examples of the aromatic diisocyanate include a compound in which an amino group in the above aromatic diamine is substituted with an isocyanate group. Examples thereof are: diisocyanates of aliphatic diamines such as ethylenediamine, propylenediamine, hexamethylenediamine; diisocyanates of alicyclic diamines such as 1,4-cyclohexanediamine, 1-3-cyclohexanediamine, isophorone-diamine, and 4,4'-dicyclohexylmethanediamine; and diisocyanates of aromatic diamines such as m-phenylenediamine, p-phenylenediamine, 4,4'-diaminodiphenylmethane, 4,4-diaminodiphenyl ether, 4,4'-diaminodiphenylsulfone, benzidine, o-tolidine, 2,4-tolylenediamine, 2,6-tolylenediamine, and xylylenediamine. These can be used singly or in combination of two or more kinds. Preferable is a polyamideimide resin obtained by using 4,4'-diphenylmethane diisocyanate, 2,4-tolylene diisocyanate, isophorone diisocyanate as the aromatic diisocyanate component.

As the conductive agent dispersed in the surface layer of the present invention, the same conductive agent as the conductive agent dispersed in the above substrate layer may be used.

For the surface layer, a high dielectric filler and an inorganic filler may be added in order to adjust relative dielectric constant and universal hardness as with the substrate layer. However, in order to reduce the image force of the intermediate transfer belt and the toner, and to prevent cracking of the surface layer, it is preferable that such a filler is less. Preferably, it is preferable not to include a high dielectric filler in the surface layer.

Further, known additives added to the resin may be appropriately blended in the surface layer, when needed. Examples of the additive include: an antioxidant, a heat stabilizer, a light stabilizer, a lubricant, an antifogging agent, a slip agent, a flame retardant, and a surface conditioner. The surface conditioner is oriented on the surface of the coating film in the drying process to uniformize the surface tension of the coating film, to prevent floating spots and repellency, and to improve wetting of the object to be coated. Concretely, for example, commercially available acrylic surface conditioners and silicone surface conditioners may be used.

The addition amount of the known additive is usually 0.01 mass % or less in the surface layer forming composition.

The thickness of the surface layer is preferably 2 to 20 μm. And more preferably it is in the range of 3 to 10 μm. From the viewpoint of compatibility of abrasion of the surface with toner, cleaning blade paper and resistance to cracking of the surface layer when used as a transfer belt, the above range is preferable.

It is preferable that the intermediate transfer belt has a shape of endless structure from the viewpoint that there is no change in thickness due to superimposition, an arbitrary portion may be set as the start position of the belt rotation, and the control mechanism of the rotation start position can be omitted.

<<Preparation Method of Intermediate Transfer Belt>>

The method for producing the intermediate transfer belt having the above-described configuration is not particularly limited, but for example, an endless intermediate transfer belt may be produced by the following method.

(1) A step of extruding a substrate layer forming composition containing a resin and a conductive agent, a high dielectric filler and, if necessary, an inorganic filler to form a substrate layer;

(2) A step of performing centrifugal molding on a surface layer forming composition containing a resin and a conductive agent by using a cylindrical mold to from a surface layer; and (3) A step of superimposing the outer surface of the substrate layer obtained in the above step (1) on the inner surface of the surface layer obtained in the above step (2) and adhering or heating to fuse it.

Alternatively, the intermediate transfer belt may be produced by laminating (2') a surface forming composition containing a resin and a conductive agent on the outer surface of the substrate layer formed in the above step (1) to form a surface layer.

Each step will be described below. The raw materials used in the preparation method of the present invention and their contents are as described above.

Step (1) (Formation of Substrate Layer)

For example, a substrate layer containing a polyamide resin may be produced by extruding a substrate layer forming composition containing a polyamide resin, a high dielectric filler, a conductive agent and, if necessary, an inorganic filler. For example, it may be produced as follows. When a polyimide resin is used as the substrate layer, a polyamic acid solution which is a precursor thereof may also be used.

First, a substrate layer forming composition is prepared by mixing a polyamide resin, a conductive agent, a high dielectric filler and, if necessary, an inorganic filler. For the mixing, known mixing means may be applied, for example, a twin screw extruder can be used. In the case of using a twin-screw extruder, it is preferable to conduct heating and kneading at a barrel temperature of about 160 to 250° C. and sufficiently dispersing and mixing.

Next, extrusion molding is performed on the substrate layer forming composition. For the extrusion molding, known extrusion molding means may be applied, for example, a single-screw extruder and a circular mandrel die for extrusion molding may be used. The thickness of the obtained substrate layer may be adjusted by suitably setting the lip width of the circular mandrel and extrusion molding conditions. A mandrel such as an air ring may be used at the die outlet in order to accurately hold the shape of the tube after discharge. It is also possible to form an endless belt by installing a circular mandrel die at the tip of the twin-screw extruder.

Since the substrate layer is obtained as a continuous tube by the extrusion molding, when it is used as an. intermediate transfer belt, it traverses with a necessary width so that it can be used as a belt.

Step (2) (Formation of Surface Layer)

For example, a surface layer containing an aromatic polyimide resin and a conductive agent may be formed as follows.

First, a surface layer forming composition is prepared by dissolving or dispersing an aromatic polyimide resin, a conductive agent, and, if necessary, the aforesaid known additives in the above-mentioned solvents such as N,N-dimethylacetamide. The aromatic polyimide resin in the surface layer forming composition is preferably 5 to 30 mass %, particularly preferably 10 to 20 mass % as the solid content concentration. Here, the solid content concentration is a value represented in percent (%) obtained by dividing the mass of the solid dissolved in the organic solvent by the mass of the solution.

Next, the surface layer forming composition is subjected to centrifugal molding using a cylindrical mold having a surface ten point average roughness (Rz: JIS B0601-1994) of 0.25 to 1.25 μm. In this case, the thickness of the obtained surface layer is adjusted to be about 2 to 20 μm.

The centrifugal molding of the surface layer is performed as follows. For example: an amount of the surface layer forming composition corresponding to the final thickness is injected into the inner surface of a rotating drum (cylindrical mold) rotated to a centrifugal acceleration of 0.5 to 10 times the gravitational acceleration; thereafter, the rotation speed is gradually increased to achieve a centrifugal acceleration 2 to 20 times the gravitational acceleration and the substance is cast uniformly over the inner surface with centrifugal force.

The inner surface of the rotating drum is polished to a predetermined surface precision and the surface state of the rotating drum is substantially transferred to the outer surface of the surface layer of the conductive endless belt of the present invention. Therefore, by controlling the surface roughness of the inner surface of the rotating drum, it is possible to adjust the surface roughness of the surface layer to a desired range. When the surface ten point average roughness (Rz) of the inner surface of the rotating drum is set in the range of 0.25 to 1.5 μm, approximately the corresponding surface ten point average roughness (Rz) of 0.25 to 1.5 μm may be obtained. However, since the surface roughness of the surface layer of the conductive endless belt picks up slight delicate sway and undulation of the belt in measurement, it tends to be a value slightly higher than the surface ten point average roughness (Rz) of the inner surface of the rotating drum. Therefore, it is also possible to adopt a rotary drum having a surface ten point average (Rz) of the inner surface which is slightly smaller than the desired surface roughness of the belt surface layer. The roughness of the inner surface of the mold to be used can be arbitrarily controlled by the count of the abrasive paper used at the time of finishing the inner surface.

The rotating drum is placed on the rotating roller and indirectly rotated by the rotation of the rotating roller. The size of the drum can be appropriately selected according to the size of the desired conductive endless belt.

Heating is carried out by indirect heating from the outside on which a heat source such as a far infrared heater is arranged around the drum. The heating temperature may vary depending on the type of resin. Usually, the temperature is raised from room temperature to around the melting point of the resin. For example, the temperature is gradually raised to about (Tm±40)° C. preferably to about (Tm−40)° C. to Tm ° C. when the melting point of the resin is Tm. Heating may be performed for about 10 to 240 minutes at a temperature after the temperature rising. As a result, a seamless tubular surface layer may be formed on the inner surface of the drum.

Step (3) (Formation of Two-Layers)

The outer surface of the substrate layer obtained in the above step (1) and the inner surface of the surface layer obtained in the above step (2) are overlapped and subjected to heat treatment.

Specifically, a known adhesion primer is applied to the inner surface of the surface layer formed in the rotating drum, and air drying is performed. Thereafter, a substrate layer coated with a dry lamination adhesive on the outer surface is inserted and superimposed. Both layers are press-bonded from the inner surface of the belt. The inner surface of the cylindrical mold is gradually heated to reach approximately 90 to 150° C., preferably approximately 90 to 120° C.

The heating rate may be, for example, about 1 to 3° C./min. Then, the above temperature is maintained for 20 to 240 minutes to form a two-layer belt having a surface layer and a substrate layer in a cylindrical mold.

Alternatively, instead of using an adhesive, heat can be applied to fuse. The heating temperature may be about 170 to 220° C., and the heating time may be about 60 to 240 minutes.

The laminated two-layer belt is peeled off from the cylindrical mold and both end portions are cut to a desired width to produce a conductive endless belt having two layers.

Further, in the above preparation method, instead of the steps (2) and (3), the surface layer-forming composition containing the aromatic polyimide-based resin and the conductive agent may be laminated on the outer surface of the substrate layer obtained in the step (1). Thereby, the conductive endless belt of the present invention may be produced.

Step (2') (Formation of Surface Layer and Formation of Two-Layers)

A surface layer containing an aromatic polyimide resin and a conductive agent may be produced by laminating a surface layer forming composition containing an aromatic polyimide resin, a conductive agent and a solvent on the outer surface of the substrate layer.

Specifically, a surface layer forming composition is coated on the outer surface of the substrate layer. As a coating method, any known methods such as spray coating method, dip coating method, or flow coating method may be used. For example, it may be produced as follows.

First, a surface layer-forming composition is prepared by dissolving or dispersing an aromatic polyimide-based resin, a conductive agent and, if necessary, the aforesaid known additives in a solvent such as N,N-dimethylacetamide.

The aromatic polyimide resin in the surface layer forming composition is preferably 5 to 30 mass %, particularly preferably 10 to 20 mass % as the solid content concentration. Here, the solid content concentration is a value represented in percent (%) obtained by dividing the mass of the solid dissolved in the organic solvent by the mass of the solution.

Next, the surface layer forming composition is laminated on the outer surface of the substrate layer. Specifically, after the substrate layer is provided on a metal mandrel, the mandrel provided with the substrate layer is immersed perpendicularly in a bath filled with a solution of the surface layer forming composition. By pulling up at a constant speed, a surface layer is formed on the substrate layer. The thickness of the surface layer on the substrate layer is proportional to the thickness (h) of the coating film before drying and its thickness is determined by the density (d) and viscosity (η) of the coating solution and the pulling speed (u). The thickness of the surface layer has a relationship represented by the following equation (2).

$$h=a(\eta u/dg)^{1/2} \quad \text{Equation (2):}$$

(Here, g represents gravitational acceleration.)

Thereafter, it is placed in a heating furnace such as an oven, and the solvent of the surface layer coating solution is dried to fix the surface layer on the substrate layer. For example, it is preferable to dry under conditions of 90 to 200° C. for 60 to 240 minutes.

When the adhesion between the substrate layer and the surface layer is insufficient, as the coating pretreatment, the outer peripheral surface of the substrate layer may be subjected to a surface treatment by means of high-frequency plasma, corona discharge, or sandblast to improve the adhesion to the surface layer.

<<Image-Forming Apparatus>>

<<Image-Forming Method and Image-Forming Apparatus>>

An image-forming method and an image-forming apparatus according to the present invention will be described in the following.

The image-forming apparatus preferably contains the following on the electrostatic latent image carrier (it may be called as a photoreceptor): a charging unit, an exposure unit, a developing unit using a developer containing a small sized toner, a transfer unit to transfer the developed toner image through an intermediated transfer belt.

Specifically, it may be cited a copying machine and a laser printer. In particular, it is preferable to use an image-forming apparatus capable of continuously printing 5,000 or more sheets of prints. In this kind of apparatus, an electric field may be easily generated between the intermediated transfer belt and the transfer material due to the production of a large amount of prints in a short time. The intermediated transfer belt of the present invention will restrain the generation of the electric field and a stable secondary transfer may be conducted.

The image-forming apparatus that may use the intermediated transfer belt of the present invention has the following members: a photoreceptor that forms an electrostatic latent image corresponding to the image information, a developing device for developing the electrostatic latent image formed on the photoreceptor, a primary transfer unit for transferring a toner image on the photoreceptor to an intermediate transfer belt, and a secondary transfer device for transferring the toner image on the intermediate transfer belt to a transfer material such as paper or an OHP sheet. By having the intermediate transfer belt of the present invention as an intermediate transfer belt, a stable toner image formation will be done without generating peeling discharge during the secondary transferring process.

As an image-forming apparatus that uses the intermediated transfer belt of the present invention, it may be cited: a mono-chromatic image-forming apparatus that forms an image with a mono-chromatic toner, a color image-forming apparatus that sequentially transfer a toner image of a photoreceptor to an intermediated transfer belt, and a tandem color image-forming apparatus that has a plurality of photoreceptors for different colors each arranged in series on an intermediated transfer belt.

The intermediate transfer belt of the present invention is effectively used for a tandem color image formation.

Figure 2:
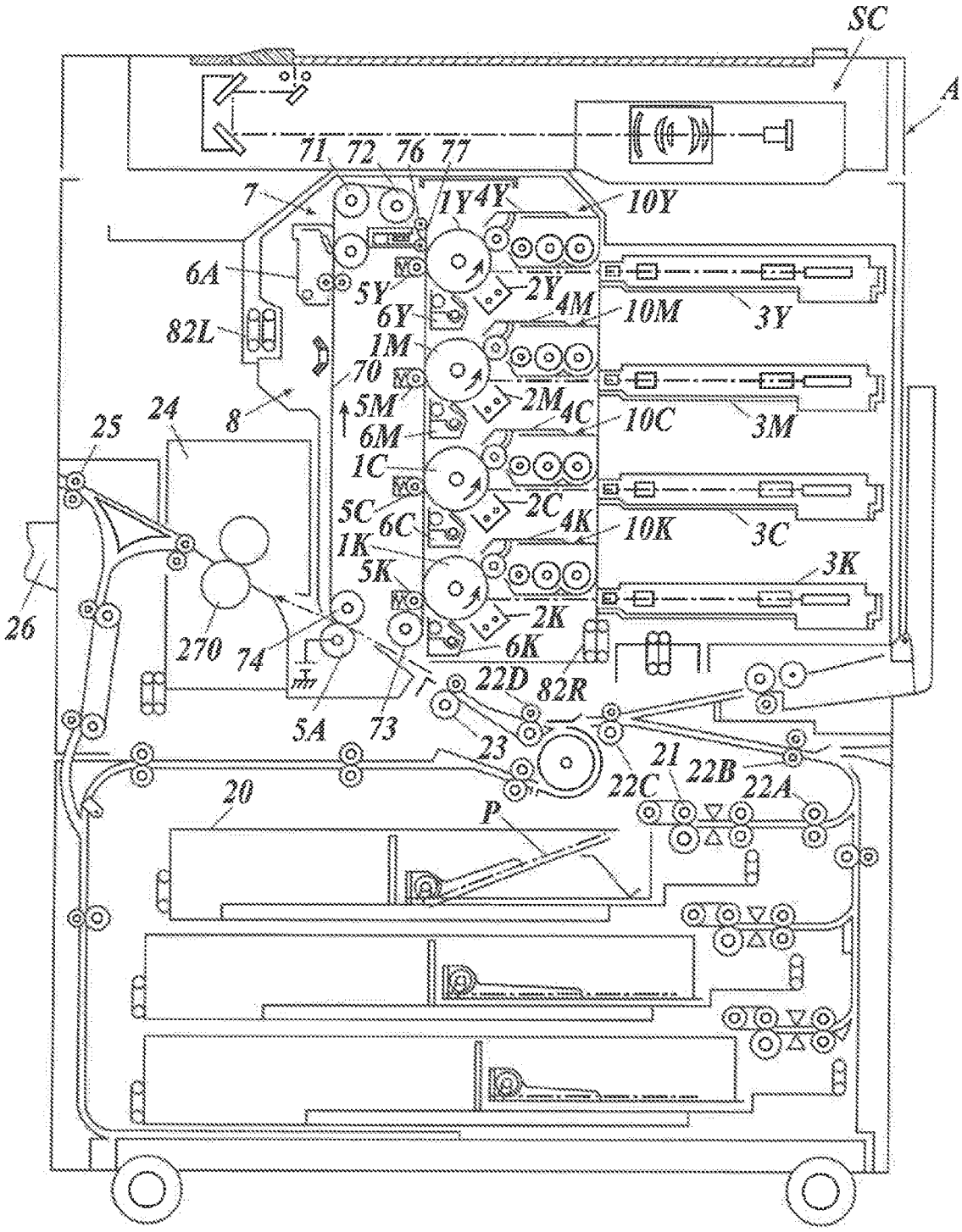
FIG. 2 is a cross-sectional constitution diagram illustrating an example of an image-forming apparatus in which an intermediate transfer belt of the present invention is usable.

FIG. 2 is a cross-sectional constitution diagram illustrating an example of an image-forming apparatus in which the intermediate transfer belt of the present invention is usable.

In FIG. 2, 1Y, 1M, 1C and 1K each designate a photoreceptor; 4Y, 4M, 4C and 4K each designate a developing unit; 5Y, 5M, 5C and 5K each designate a primary transfer roller as a primary transfer unit; 5A designates a secondary transfer roller as a secondary transfer device; 6Y, 6M, 6C and 6K each designate a cleaning unit; the numeral 7 designates an endless intermediate transfer belt unit; the numeral 24 designates a heat roller fixing device, and the numeral 70 designates an endless intermediate transfer belt.

This image-forming apparatus is called a tendent color image-forming apparatus, which is composed of: a plurality of image-forming sections 10Y, 10M, 10C and 10K; an endless intermediate transfer belt unit 7 as a transfer section; a paper feeding and conveying unit 21 is an endless belt form to convey a recording member P; and a heat roller fixing device 24. An original image reading device SC is disposed in the upper section of the image-forming apparatus body A.

For one of the color toner images on the each photoreceptors, the image-forming section 10Y that forms a yellow image contains: a drum-form photoreceptor 1Y as a first image carrier; an electrostatic-charging unit 2Y which is disposed around the photoreceptor 1Y; an exposure unit 3Y; and a developing unit 4Y; a primary transfer roller 5Y as a primary transfer unit; and a cleaning unit 6Y.

For another color toner image, the image-forming section 10M that forms a magenta image contains: A drum-form photoreceptor 1M as a first image carrier; an electrostatic-charging unit 2M which is disposed around the photoreceptor 1M; an exposure unit 3M; and a developing unit 4M; a primary transfer roller 5M as a primary transfer unit; and a cleaning unit 6M.

For another color toner image, the image-forming section 10C that forms a cyan image contains: a drum-form photoreceptor 1C as a first image carrier; an electrostatic-charging unit 2C which is disposed around the photoreceptor 1C; an exposure unit 3C; and a developing unit 4C; a primary transfer roller 5C as a primary transfer unit; and a cleaning unit 6C.

And further, for another color toner image, the image-forming section 10K that forms a black image contains: a drum-form photoreceptor 1K as a first image carrier; an electrostatic-charging unit 2K which is disposed around the photoreceptor 1K; an exposure unit 3K; and a developing unit 4K; a primary transfer roller 5K as a primary transfer unit; and a cleaning unit 6K.

The endless intermediate transfer belt unit 7 includes: the endless intermediate transfer belt 70 as a secondary image carrier that is wound and rotatably supported by a plurality of rollers.

The individual color images formed in the image-forming sections 10Y, 10M, 10C and 10K are successively transferred onto the moving endless intermediate transfer belt 70 by the primary transfer rollers 5Y, 5M, 5C and 5K, respectively, to form a composite color image. The recording member P made of paper, as a final transfer material housed in a paper feed cassette 20, if fed by a paper feed and conveyance unit 21 and conveyed to a secondary transfer roller 5A through a plurality of intermediate rollers 22A, 22B, 22C and 22D and a resist roller 23, and color images are transferred together on the recording member P. The color image transferred on the recording member (P) is fixed by a heat roller fixing device 24. Then the paper is nipped by a paper discharge roller 25, and put onto a paper discharge tray 26 placed outside of the apparatus.

On the other hand, after transferring the color image onto the transfer material P with the second transferring roller 5A, and after conducting the curved separation of the transfer material P from the endless intermediate transfer belt 70, the residual toner on the endless intermediate transfer belt 70 is removed by the cleaning unit 6A.

During an image-forming process, the primary transfer roller 5K is always compressed to the photoreceptor 1K. Other primary rollers 5Y, 5M and 5C are compressed to the photoreceptors 1Y, 1M and 1C, respectively, only when the color images are formed.

The secondary transfer roller 5A is compressed onto the endless intermediate transfer belt 70 only when the recording member P passes through to perform secondary transfer.

A housing 8 has a structure which can be drawn from the apparatus body A via rails 82L and 82R.

The housing 8 accommodates the image-forming sections 10Y, 10M, 10C, and 10K, and the endless intermediate transfer belt unit 7.

The image-forming sections 10Y, 10M, 10C, and 10K are aligned in the vertical direction. The endless intermediate transfer belt unit 7 is disposed on the left of the photoreceptors 1Y, 1M, 1C, and 1K in the figure.

The endless intermediate transfer belt unit 7 includes: the endless intermediate transfer belt 70 that are rotatably wound around a plurality of rollers 71, 72, 73, and 74; the first transfer rollers 5Y, 5M, 5C, and 5K; and the cleaning unit 6A.

By the operation of drawing the housing 8, the image-forming sections 10Y, 10M, 10C, and 10K, and the endless intermediate transfer belt unit 7 are taken out as a whole from the apparatus body A.

As described above, in the process of image formation, toner images are formed on the photoreceptors 1Y, 1M, 1C and 1K, through electrostatic-charging, exposure and development. The toner images of the individual colors are superimposed on the endless intermediate transfer belt 70, the images are transferred together onto the recording member P, and fixed by compression and heating in the heat roller fixing device 24. After completion of transferring the toner image to the recording member P, any toner remained on the photoreceptors 1Y, 1M, 1C and 1K is cleaned by the cleaning device 6A and then goes into the foregoing cycle of electrostatic-charging, exposure and development to perform the subsequent image formation.

<Transfer Material>

The transfer material used in the present invention is a support to hold a toner image. It may be used a various materials such as: a plain paper from thin paper to thick paper, a printing paper of an art paper and a coat paper, a commercially available Japanese paper and a post card paper, a plastic film for OHP, and a cloth. In the present invention, it is suitably used a paper having a large uneven surface structure treated with an embossed processing, and a basis weight in the range of 150 to 300 gsm.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, the present invention will be specifically described with reference to examples, but the present invention is not limited thereto. In the present examples, the description of "parts" or "%" is used, it represents "mass parts" or "mass %" unless specific notice is given.

Example 1

(Preparation of Carbon Dispersion Liquid 1)

To a mixed solution of 67 mass parts of polyamide imide resin "VYLOMAX™ HR-11NN (solid content 15 mass %)" (manufactured by Toyobo Co. Ltd.) and 20 mass parts of NMP were added 13.5 mass parts of "PRINTEX™ 150T" (manufactured by Orion Engineered Carbons, pH 4, volatile content: 10%). The mixture was dispersed in a ball mill to obtain a carbon dispersion liquid 1.

(Preparation of Carbon Dispersion Liquid 2)

A carbon dispersion liquid 2 was obtained in the same manner as preparation of the carbon dispersion liquid 1 except that 67 mass parts of "VYLOMAX™ HR-11NN" was changed to 55 mass parts of polyimide precursor "UPIA™-ST 1001 (solid content: 18% by mass)" (manufactured by Ube Industries, Ltd.).

(Preparation of High dielectric Filler Dispersion Liquid 1)

30 mass parts of fine particles of barium titanate were mixed with 70 mass parts of N-methyl-2-pyrrolidone (NMP). The mixture was subjected to ultrasonic wave to obtain a high dielectric filler dispersion liquid 1.

(Preparation of High Dielectric Filler Dispersion Liquid 2)

In the preparation of the High dielectric filler dispersion liquid 1, barium titanate was changed to strontium titanate, whereby a high dielectric filler dispersion liquid 2 was obtained.

(Preparation of Surface Layer Liquid 1)

"UPIA™-ST 1001 (solid content 18 mass %)" was used.

(Preparation of Surface Layer Liquid 2)

A methyl ethyl ketone solution (solid content 5 mass %) of polyvinylidene fluoride "KYNAR™ 740" (manufactured by Tokyo Materials Co., Ltd.) was used.

(Preparation of Surface Layer Liquid 3)

A 2-propanol solution (solid content 10 mass %) of a siloxane resin "Maxsil™ V1" (manufactured by Max Electronic Materials Co., Ltd.) was used.

<<Preparation of Intermediate Transfer Belt 1>>

83 mass parts of polyamide imide resin "VYLOMAX™ HR-11NN (solid content 15 mass %)" (manufactured by Toyobo Co. Ltd.), 105 mass parts of the carbon dispersion liquid 1, and 210 mass parts of the high dielectric filler dispersion liquid 1 were mixed and defoamed. The coaling was applied to the inner peripheral surface of a cylindrical mold via a dispenser so that the thickness after drying was 60 μm and the mold was rotated at 1500 rpm for 15 minutes to form a developed layer of the varnish having a uniform thickness. Next, while rotating the mold at 250 rpm, hot air of 60° C. was applied to the mold from the outside of the mold for 30 minutes. Then, the mold was heated at 150° C. for 60 minutes. Thus, a substrate layer belt 1 having an endless belt form was obtained.

The surface layer liquid 1 was applied to the surface of the resulting substrate layer belt 1 using a coating device by a dip coating method so as to have a thickness after drying of 3 μm to form a coating film. Hot air of 60° C. was applied for 10 minutes. Thereafter, the mold was heated at 150° C. for 15 minutes, then the mold was heated to 360° C. at a heating rate of 2° C./min, and further heated at 360° C. for 10 minutes. From the developed layer, the evaporated solvent and water generated along with dehydration ring closure were removed, and the imide conversion reaction in the development layer was completed, whereby an intermediate transfer belt was obtained.

<<Preparation of Intermediate Transfer Belt 2>>

145 mass parts of polyimide precursor "UPIA™-ST 1001 (solid content 18 mass %)" (manufactured by Ube Industries, Ltd.), 47 mass parts of the carbon dispersion liquid 2, and 210 mass parts of the high dielectric filler dispersion liquid 1 were mixed and defoamed. The coating was applied to the inner peripheral surface of a cylindrical mold via a dispenser so that the thickness after drying was 60 μm and the mold was rotated at 1500 rpm for 15 minutes to form a developed layer of the varnish having a uniform thickness. Next, while rotating the mold at 250 rpm, hot air of 60° C. was applied to the mold from the outside of the mold for 30 minutes. Thereafter the mold was heated at 150° C. for 60 minutes. Then, the mold was heated to 360° C. at a heating rate of 2° C./min, and further heated at 360° C. for 60 minutes. From the developed layer, the evaporated solvent and water generated along with dehydration ring closure were removed, and the imide conversion reaction in the development layer was completed, whereby a substrate layer belt 2 having an endless belt form was obtained.

The surface layer liquid 1 was applied to the surface of the resulting substrate layer belt 2 using a coating device by a dip coating method so as to have a thickness after drying of 20 μm to form a coating film. Thus an intermediate transfer belt 2 was obtained.

<<Preparation of Intermediate Transfer Belt 3>>

The surface layer liquid 2 was applied to the surface of the resulting substrate layer belt 2 using a coating device by a dip coating method so as to have a thickness alter drying of 5 μm to form a coating film. Hot air of 60° C. was applied for 10 minutes. Then, it was dried at 120° C. for 20 minutes, whereby an intermediate transfer belt 3 was obtained.

21 <Preparation of Intermediate Transfer Belt 4>>

An intermediate transfer belt 4 was obtained in the same manner as preparation of the intermediate transfer belt 3 except that the type and the liquid amount (mass part) of the high dielectric filler dispersion liquid, the liquid amount (mass part) of the carbon dispersion liquid and the resin used in the preparation of the intermediate transfer belt 3 were changed as indicated in Table I.

<<Preparation of Intermediate Transfer Belt 5>>

A substrate layer belt 4 was prepared in the same manner as preparation of the intermediate transfer belt 2 except that the liquid amount (mass part) of the high dielectric filler dispersion liquid, the carbon dispersion liquid and the resin used in the preparation of the intermediate transfer belt 2 were changed as indicated in Table I. Thereafter, the surface layer liquid 3 was applied to the surface of the resulting substrate layer belt 4 using a coating device by a dip coating method so as to have a thickness after drying of 5 μm to form a coating film. Hot air of 60° C. was applied for 10 minutes. Then, it was dried at 200° C. for 30 minutes, whereby an intermediate transfer belt 5 was obtained.

<<Preparation of Intermediate Transfer Belt 6>>

A substrate layer belt 3 was prepared in the same manner as preparation of the intermediate transfer belt 2 except that the liquid amount (mass part) of the high dielectric filler dispersion liquid, the carbon dispersion liquid and the resin used in the preparation of the intermediate transfer belt 2 were changed as indicated in Table I. Thereafter, the surface layer liquid 3 was applied to the surface of the resulting substrate layer belt 5 using a coating device by a dip coating method so as to have a thickness after drying of 8 μm to form a coating film. Hot air of 60° C. was applied for 10 minutes. Then, it was dried at 200° C. for 30 minutes, whereby an intermediate transfer belt 6 was obtained.

<<Preparation of Intermediate Transfer Belts 7 to 9>>

Substrate layer belts 6 to 8 were prepared in the same manner as preparation of the intermediate transfer belt 2 except that the type and amount (mass part) of the high dielectric filler dispersion liquid, the carbon dispersion liquid and the resin used in the preparation of the intermediate transfer belt 2 were changed as indicated in Table I. Thereafter, the surface layer liquid 1 was applied to the surface of the resulting substrate layer belts 6 to 8 using a coating device by a dip coating method so as to have a thickness after drying of 3 μm to form a coating film. Thus intermediate transfer belts 7 to 9 were obtained.

<<Preparation of Intermediate Transfer Belt 10>>

In the preparation of the substrate layer belt 2, a surface layer having the same composition as the substrate layer belt 2 was provided with a thickness of 5 μm. That is, in the same manner as the substrate layer belt 2, an intermediate transfer belt 10 was obtained in such a manner that the thickness of the intermediate transfer belt after drying was 63 μm.

In the column of the resin No. of the substrate layer in Table I, "1" represents "VYLOMAX™ HR-11NN" (manufactured by Toyobo Co., Ltd.), and "2" represents "UPIA™-ST 1001 (solid content 18 mass %)" (manufactured by Ube Industries, Ltd.). The relative dielectric constant and the volume resistivity of the intermediate transfer belt and the relative dielectric constant of the surface layer were measured by the method described above. An impedance analyzer 4990A (manufacture by Keysight Co. Ltd.) was used for the measurement of the relative dielectric constant. The measurement results are indicated in Table I.

| | Substrate layer | | | | | | | Surface layer | | Intermediate transfer belt | | | |
|---|---|---|---|---|---|---|---|---|---|---|---|---|---|
| | Belt | *2 | | Carbon dispersion liquid | | Resin | | Surface layer liquid | Thickness after drying | Volume resistivity | Surface layer Relative dielectric | Universal hardness | |
| *1 | No. | No. | *3 | No. | *3 | No. | *3 | No. | (μm) | *4 (Ω · cm) | constant | (MPa) | Remarks |
| 1 | 1 | 1 | 210 | 1 | 105 | 1 | 83 | 1 | 3 | 15 $5.0 \times 10^5$ | 3 | 50 | Present invention |
| 2 | 2 | 1 | 210 | 2 | 47 | 2 | 145 | 1 | 20 | 15 $9.0 \times 10^9$ | 3 | 50 | Present invention |
| 3 | 2 | 1 | 210 | 2 | 47 | 2 | 145 | 2 | 5 | 15 $9.0 \times 10^9$ | 6 | 40 | Present invention |
| 4 | 3 | 2 | 256 | 2 | 52 | 2 | 61 | 2 | 5 | 25 $1.0 \times 10^9$ | 6 | 40 | Present invention |
| 5 | 4 | 1 | 250 | 2 | 78 | 2 | 34 | 3 | 5 | 30 $7.0 \times 10^6$ | 5 | 70 | Present invention |
| 6 | 5 | 1 | 266 | 2 | 63 | 2 | 46 | 3 | 8 | 45 $4.0 \times 10^8$ | 5 | 70 | Present invention |
| 7 | 6 | — | — | 2 | 115 | 2 | 405 | 1 | 3 | 5 $1.0 \times 10^9$ | 3 | 50 | Comparative Example |
| 8 | 7 | 1 | 210 | 2 | 37 | 2 | 156 | 1 | 3 | 15 $1.0 \times 10^{11}$ | 3 | 50 | Comparative Example |
| 9 | 8 | 1 | 204 | 2 | 158 | 2 | 9 | 1 | 3 | 15 $6.0 \times 10^4$ | 3 | 50 | Comparative Example |
| 10 | 2 | 1 | 210 | 2 | 47 | 2 | 145 | *5 | 5 | 15 $9.0 \times 10^9$ | 15 | 50 | Comparative Example |

*1: Intermediate transfer belt No.
*2: High dielectric filler dispersion liquid
*3: Liquid amount (mass part)
*4: Intermediate transfer belt Relative dielectric constant
*5: The same composition as the substrate layer belt 2

<<Evaluation of Intermediate Transfer Belt>>

The intermediate transfer belt 1 was mounted as an intermediate transfer belt of an image-forming apparatus "bizhub™ PRESS C1100" (manufactured by Konica Minolta, Inc.). Evaluation tests of uneven paper transferability and thin line stability were carried out using embossed paper (Leathac paper 302 g) as an image support. Evaluation test of durability was carried out using plain paper (J paper, manufactured by Konica Minolta, Inc.). Further, the universal hardness was measured by the above-mentioned method.

(Uneven Paper Transferability)

Evaluation machines were prepared by attaching the prepared intermediate transfer belt to the image-forming apparatus "bizhub™ PRESS C1100" (manufactured by Konica Minolta, Inc.). Using this, ten solid images with a toner concentration of 100% were respectively output on a Lezac paper (uneven paper). Each solid image obtained was digitalized by a scanner. Using image editing and processing software ("Photoshop (registered trademark)" manufactured by Adobe Systems Incorporated), average values of image density of each solid image were obtained by image processing. Then, the area ratio of the area having 90% or less of the average value in each solid image was obtained, and the average value for each intermediate transfer belt having the area ratio was calculated. This was defined as an area ratio of image density of 90% or less. This was evaluated according to the following evaluation criteria.

A: Area ratio of image density of 90% or less is less than 2% (acceptable)

B: Area ratio of image density of 90% or less is 2% or more and less than 4% (acceptable)

C: Area ratio of image density of 90% or less is 4% or more and less than 6% (acceptable)

D: Area ratio of image density of 90% or less is 6% or more and less than 8% (acceptable)

E: Area ratio of image density of 90% or less is 8% or more and less than 10% (unacceptable)

F: Area ratio of image density of 90% or less is 10% or more and less than 20% (unacceptable)

G: Area ratio of image density of 90% or less is 20% or more (unacceptable)

(Thin Line Stability)

Thin line stability was evaluated by outputting a thin line image which is difficult to transfer to uneven paper by the following method. Using the above image forming apparatus, a cross line image of 8 dots of red (yellow+magenta) was formed on the paper. For the formed image, a line analysis was performed on the vertical line of the cross line using a handy type image evaluation system (PIAS-II; Trek Japan Co., Ltd.). The total value of the widths of the blurriness at both ends measured at a threshold value of 10% was taken as a line width and evaluated according to the following criteria.

○: Line width<260 μm (acceptable)

Δ: 260 μm≤Line width<300 μm (acceptable)

x: 300 μm≤Line width<300 μm (unacceptable).

(Durability)

A durability test was carried out in which an image having a coverage rate of 10% was formed on 1,00,000 sheets of J paper (manufactured by Konica Minolta, Inc.) by using an image-forming apparatus "bizhub™ PRESS C1100" (manufactured by Konica Minolta, Inc.) attached with the prepared intermediate transfer belt. Before and after the durability test, the surface ten point average roughness of the intermediate transfer belt was measured according to JIS B 0601-1994 surface ten point average roughness (Rz), and the difference ΔRz was evaluated according to the following evaluation criteria.

◎: Difference ΔRz of surface ten point average roughness (Rz) is less than 0.5 μm (acceptable)

○: Difference ΔRz of the surface ten point average roughness (Rz) is 0.5 μm or more and less than 1.0 μm (acceptable)

x: Difference ΔRz of the surface ten point average roughness (Rz) is 1.0 μm or more (unacceptable)

Although the intermediate transfer belt 9 was damaged in the course of durability test and it was not possible to measure the surface ten point average roughness, the evaluation was set to x (unacceptable) because there was a defect in practical use.

The above evaluation results are indicated in Table II.

TABLE II

| Intermediate transfer belt | | | | | Evaluation result | | | | |
|---|---|---|---|---|---|---|---|---|---|
| *1 | *2 | Volume resistivity (Ω · cm) | *3 | *4 (μm) | Universal hardness (MPa) | *5 | Thin line stability | Durability | Remarks |
| 1 | 15 | $5.0 \times 10^5$ | 3 | 3 | 50 | C | Δ | ○ | Present invention |
| 2 | 15 | $9.0 \times 10^9$ | 3 | 20 | 50 | C | ○ | ◎ | Present invention |
| 3 | 15 | $9.0 \times 10^9$ | 6 | 5 | 40 | D | ○ | ○ | Present invention |
| 4 | 25 | $1.0 \times 10^9$ | 6 | 5 | 40 | C | ○ | ○ | Present invention |
| 5 | 30 | $7.0 \times 10^6$ | 5 | 5 | 70 | B | ○ | ○ | Present invention |
| 6 | 45 | $4.0 \times 10^8$ | 5 | 8 | 70 | A | ○ | ◎ | Present invention |
| 7 | 5 | $1.0 \times 10^9$ | 3 | 3 | 50 | G | ○ | ◎ | Comparative Example |
| 8 | 15 | $1.0 \times 10^{11}$ | 3 | 3 | 50 | E | ○ | ○ | Comparative Example |
| 9 | 15 | $6.0 \times 10^4$ | 3 | 3 | 50 | D | X | X | Comparative Example |
| 10 | 15 | $9.0 \times 10^9$ | 15 | 5 | 50 | G | ○ | X | Comparative Example |

*1: Intermediate transfer belt No.

*2: Intermediate transfer belt Relative dielectric constant

*3: Surface layer Relative dielectric constant

*4: Thickness of the surface layer after drying

*5: Uneven paper transferability

From Table II, it can be seen that the intermediate transfer belt of the present invention is specifically superior in uneven paper transferability as well as durability.

What is claimed is:

1. An intermediate transfer belt used for an electrophotographic image-forming apparatus, wherein the intermediate transfer belt comprises a substrate layer and a surface layer; the intermediate transfer belt has a relative dielectric constant of 15 or more, and a volume resistivity at an applied voltage of 100 V in the range of $1.0\times10^5$ to $9.0\times10^9$ Ω·cm under an environment of temperature of 23° C. and humidity of 50% RH; and the surface layer has a relative dielectric constant of 6 or less.

2. The intermediate transfer belt described in claim 1, wherein the relative dielectric constant of the intermediate transfer belt is in the range of 20 to 60.

3. The intermediate transfer belt described in claim 1, wherein the volume resistivity of the intermediate transfer belt is in the range of $5.0\times10^6$ to $5.0\times10^8$ Ω·cm.

4. The intermediate transfer belt described in claim 1, wherein the relative dielectric constant of the surface layer is in the range of 3 to 5.

5. The intermediate transfer belt described in claim 1, wherein the substrate layer contains a filler having a high dielectric constant.

6. The intermediate transfer belt described in claim 1, wherein a universal hardness value on a surface layer side of the intermediate transfer belt is in the range of 50 to 80 MPa ($N/mm^2$) when measurement is done by pressing with a Vickers square pyramid indenter at a maximum load of 2 mN under an environment of temperature of 23° C. and humidity of 50% RH.

7. The intermediate transfer belt described in claim 1, wherein the surface layer of the intermediate transfer belt has a thickness in the range of 2 to 20 μm.

8. An image-forming apparatus provided with the intermediate transfer belt described in claim 1.

* * * * *